US006285244B1

(12) United States Patent
Goldberg

(10) Patent No.: US 6,285,244 B1
(45) Date of Patent: Sep. 4, 2001

(54) LOW VOLTAGE, VCC INCENTIVE, LOW TEMPERATURE CO-EFFICIENT, STABLE CROSS-COUPLED BANDGAP CIRCUIT

(75) Inventor: Daniel E. Goldberg, Denison, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/410,921

(22) Filed: Oct. 2, 1999

(51) Int. Cl.[7] ..... G05F 1/575

(52) U.S. Cl. ..... 327/539; 327/542; 323/314; 323/315

(58) Field of Search ..... 327/539, 540, 327/541, 542; 323/313, 314, 315

(56) References Cited

U.S. PATENT DOCUMENTS 4,816,742 * 3/1989 Van De Plassche ..... 323/314
4,958,122 * 9/1990 Main ..... 323/315
5,576,616 * 11/1996 Ridgers ..... 323/314
6,002,293 * 12/1999 Brokaw ..... 327/540

* cited by examiner

*Primary Examiner*—Timothy P. Callahan
*Assistant Examiner*—Terry L. Englund
(74) *Attorney, Agent, or Firm*—Alan K. Stewart; Wade James Brady, III; Frederick J. Telecky, Jr.

(57) ABSTRACT

A cross-coupled bandgap circuit (10, 30) generates a stable voltage reference ($V_{ref}$) at an output port (12, 32). The circuit comprises a cross-coupled current source (14, 34) coupled to a Wilson current mirror (16,36) mirroring a first current through the current source (14,34) to a current sink (18, 38), and also to a voltage generator generating the stable voltage reference. The circuit may be implemented in bi-polar, Bi-CMOS or CMOS circuitry, and is very stable across varying temperatures, varying and noisy operating voltages, between low and high operating voltages, and is stable at low operating currents.

11 Claims, 7 Drawing Sheets

LOW VOLTAGE, VCC INCENTIVE, LOW TEMPERATURE CO-EFFICIENT, STABLE CROSS-COUPLED BANDGAP CIRCUIT

TECHNICAL FIELD

The present invention is generally related to integrated circuits, and more particularly to cross-coupled bandgap circuits and voltage reference circuits.

BACKGROUND OF THE INVENTION

In electrical circuits, and particularly integrated circuits (ICs), there is often a need to provide stable reference voltages and reference currents for use throughout the IC. These reference circuits attempt to provide stable and known voltages that vary little over time and temperature variations.

One such type of reference circuit is known as a cross-coupled bandgap circuit. Cross-coupled bandgap circuits are often used in operational amplifiers, voltage regulators, phase locked loops (PLLs), and other devices requiring a VCC insensitive reference generator.

Problems with many conventional cross-coupled bandgap circuits include that they are often times sensitive to low frequency noise on the VCC line, are temperature unstable, have varying reference voltages as the VCC varies between a low and high operating voltage.

There is desired an improved reference circuit, such as a cross-coupled bandgap circuit, that is temperature stable, VCC insensitive, and minimally effected by VCC sources having noise or voltage spikes thereon.

SUMMARY OF THE INVENTION

The present invention achieve technical advantages as a cross-coupled bandgap circuit having a current generator comprised of cross-coupled transistors being driven by a current mirror which operates to provide a stable voltage reference by canceling out the effects of varying temperatures during operation, as well as varying supply voltages and noise on the voltage source.

The present invention comprises a circuit providing a reference voltage to an output, comprising a current generator having a drive node and comprised of cross-coupled transistors. The current generator generates a first current. A current mirror is drivingly coupled to the current generator drive node and generates a second current mirrored to the first current. A reference current generator is also mirrored to this second current, this reference current generating the reference voltage. Preferably, this reference current is generated by a resistor and diode in series and tied to ground. The current mirror driving the cross-coupled transistors preferably comprises a multi-collector—PNP-Wilson current mirror. Further provided is a current sink circuit receiving the mirrored second current from the Wilson current mirror for sinking the second current to ground. This current sink preferably comprises 2 diodes, but their sizes do not require them to match the current generator sizes, and preferably comprises of serially connected diodes formed from bi-polar junction transistors (BJTs) with the respective collectors tied to the base.

The cross-coupled bandgap circuit is fabricated on a common die, wherein the pair of transistors forming the Wilson current mirror have approximately the same die area as at least three of the transistors forming the cross-coupled current generator.

The Wilson current mirror preferably comprises of at least one transistor having multiple collectors, with a first collector coupled to and driving the drive node of the cross-coupled current source, and a second collector being coupled to the reference current generator. The second current from the second collector of the Wilson current mirror is conducted through the current sink to ground, preferably through the two diodes which essentially establish approximately a 1.2 reference voltage at the emitter of the Wilson current mirror and also at the drive node of the cross-coupled current generator. The voltage reference is provided as an output of one of the multiple collectors of the Wilson current mirror, and is established by conducting the mirrored second current through a resistor and a diode serially connected to ground.

BRIEF DESCRIPTION OF THE DRAWINGS

Other aspects of the invention including specific embodiments are understood by reference to the following detail description taken in conjunction with the detail drawings, wherein like numerals refer to like elements, in which.

DETAILED DESCRIPTION OF PREFERRED EMBODIMENTS

Figure 1:
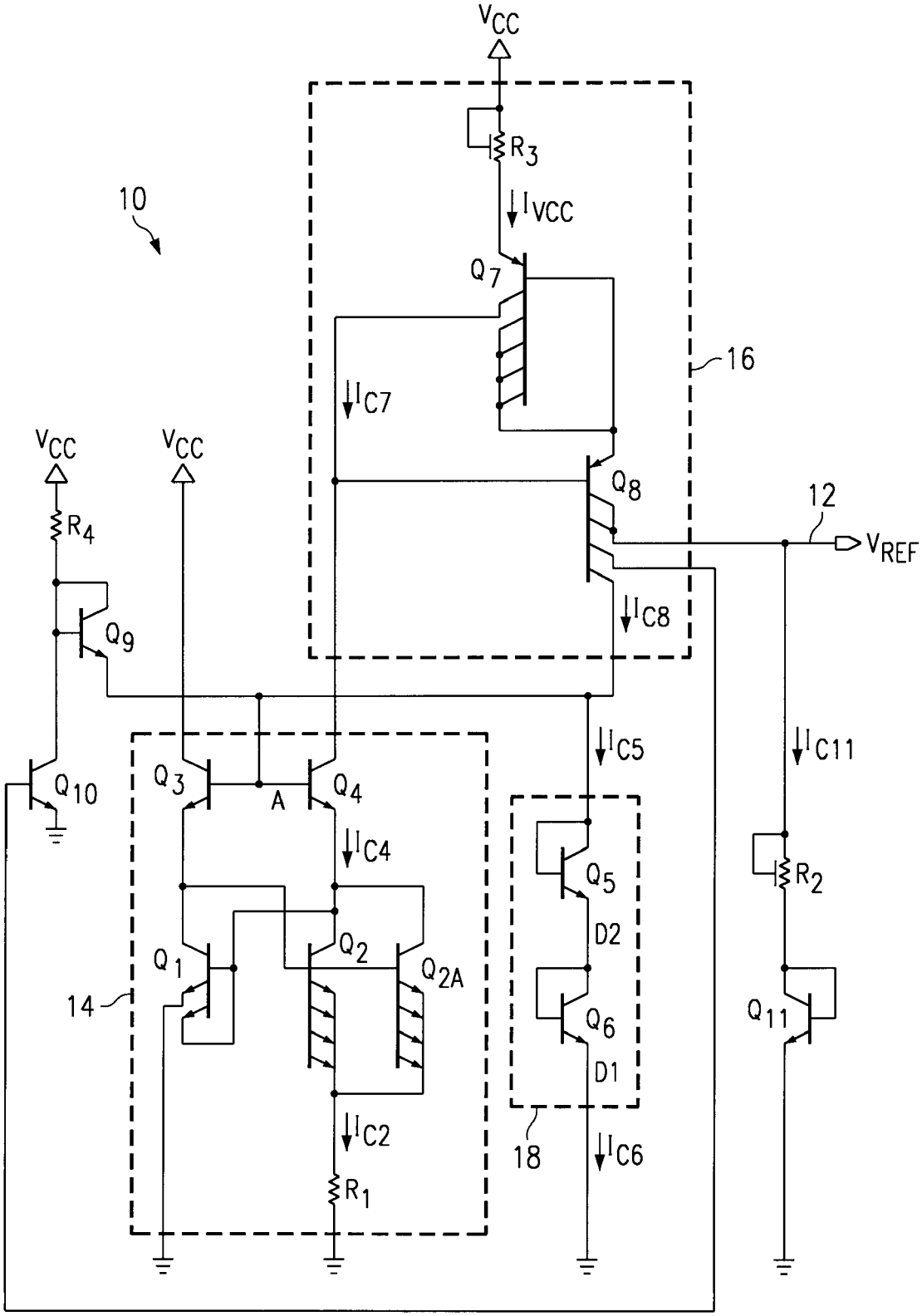
FIG. 1 is a schematic view of a first embodiment to the present invention illustrated as a cross-coupled bandgap circuit implemented with bi-polar devices.

Referring now to FIG. 1, there is generally shown at 10 a cross-coupled bandgap circuit generating a reference voltage $V_{ref}$ at output port 12. The principal subcircuits of circuit 10 include a cross-coupled current source generally shown at 14, a Wilson current mirror generally shown at 16, a current sink generally shown at 18, and a current generator including resistor $R_2$ and transistor $Q_{11}$. The combination of the Wilson current mirror 16, and the current sink 18, along with the cross-coupled circuit 14, achieves technical advantages as a voltage reference generator that is relatively insensitive across a wide range of operating temperatures, between a low and high operating VCC voltage, that does not require a capacitor, and can operate at relatively low operating voltages as well up to a large operating voltage all on a single die, and having fairly low operating currents. The first preferred embodiment of the present invention generally shown at 10 is implemented with bi-polar devices, but may be implemented in bi-CMOS and pure CMOS as well, whereby a bi-CMOS circuit shown in FIG. 8 will be described shortly.

With continued reference to FIG. 1, there is shown the cross-coupled current source 14 comprising of BJT transistors $Q_1$, $Q_2$, $Q_3$, and $Q_4$. In particular, transistor $Q_2$ is actually an 8 emitter transistor, as illustrated and will be described more shortly. A driving node of the current source 14 is illustrated at A and is located at the node defined as the common connection of the bases of $Q_3$ and $Q_4$. The emitters of transistors $Q_2$ are all tied to the emitter resistor R1 which conducts the collector current $I_{c2}$ to ground, where it is assumed that the Beta of each of the transistors, particularly the Beta of transistor $Q_2$, is assumed to be substantially greater than 0.

With reference to the Wilson current mirror 16, there is illustrated multiple collector PNP transistors $Q_7$ and $Q_8$ forming the current mirror. The Wilson current 16 is shown to include a variable resistor $R_3$ conducting current from the voltage supply $V_{CC}$ and illustrated as $I_{vcc}$. A first collector of the Wilson current mirror shown as one of the collectors of $Q_8$ is coupled to the cross-coupled current source 14 at node A. The current $I_{c8}$ conducted through each collector of PNP transistor mirrors the current $I_{c2}$ from the collector of $Q_7$ conducting through resistor $R_1$ as current $I_{c2}$ of the cross-coupled current source 14.

The mirrored current $I_{c8}$ conducting through the collector of transistor $Q_8$ is conducted as current $I_{c2}$ through the current sink circuit 18, comprising of transistors $Q_5$ and $Q_6$ each actually configured as diodes with the respective collectors tied to the base thereof. In effect, current sink 18 comprises a pair of serially connected diodes configured between ground and drive node A. These diodes create an effective voltage potential of about 1.2 volts at node A and drive the current source 14. The mirrored current $I_{c5}$ fed to the serially connected transistors $Q_5$ and $Q_6$, acting as a current sink, also derives the technical advantages of providing a stable base current drive at node A.

The bandgap voltage $V_{ref}$ at output 12 is formed by the mirrored current $I_{c11}$ from the collector of Q8 conducting through the variable resistor $R_2$ and transistor $Q_{11}$, configured as a diode with the collector tied to the base thereof. Another one of the collectors of the transistor PNP $Q_8$ is tied back to the base of transistor $Q_{10}$ to form a feedback loop for startup, whereby the collector of $Q_{10}$ is tied to $V_{cc}$ via resistor $R_4$ and to the base of transistor $Q_9$ configured as a diode with the collector tied to the base thereof The emitter of $Q_9$ is tied to drive node A.

To understand the technical advantages of the present invention, it is noted that the voltage between the base and emitter of transistor $Q_1(V_{be1})+V_{be4}=V_{be5}+V_{be6}$.

Since $I_{c4}=I_{c5}=I_{c6}$, and where all respective transistors have the same surface area in silicon, then;

$$V_{be1}=V_{be4}=V_{be5}=V_{be6}.$$

Furthermore, the temperature coefficient of transistor $Q_5$ and $Q_6$ both match that of transistor $Q_1$ and $Q_4$. Thus, the base drive to drive node A is just enough current to run the current generator 14, without effecting its temperature coefficient.

Transistors $Q_5$ and $Q_6$ serve an additional function. In the case where the supply voltage $V_{cc}$ has superimposed thereon noise such as a square wave, it is known that both metal oxide semiconductor (MOS) and PNP-bi-polar transistors suffer from either poor early voltage or channel length modulation effects. Thus, as the voltage $V_{CE}$ or $V_{DS}$ changes, so does the respective current $I_c$ or $I_d$, being the respective collector current or drain current. This will effect the drive node A. Large disturbances on the drive node A can have dramatic effects on performance. According to the present invention, by using serially connected transistors (diodes) $Q_5$ and $Q_6$ effectively as a current sink, any additional undesired current will thus advantageously pass through both transistors $Q_5$ and $Q_6$, with resulting minimal effects being passed to the drive node A. The present invention derives technical advantages because a capacitor is not required to maintain stability and maintain supply insensitivity. However, it is recognized that at higher frequencies, such as above 20 mHz, a capacitor of between 2 pF and 5 pF is noticed to improve performance.

It is conventionally known that the typical model of a BJT transistor is represented by the equation:

$$Ic=IseVbe/V_T$$

where:

$$V_T = \frac{kT}{Q}$$

is Boltzman's constant, T is temperature, Q is electron charge, current I is the saturation current from the collector to the base of the transistor, and the voltage $V_{be}$ is the junction voltage across the base to emitter of the transistor.

In the case of transistor $Q_2$ having 8 emitters, it can be derived that the collector conducting through the current of transistor $Q_2$ is represented by the equation:

$$I_{c2}=V_t 1n(8)/R_1.$$

This equation further holds true even if the transistors $Q_5$ and $Q_6$ occupy half the silicon area of transistors $Q_1$, $Q_3$ and $Q_4$. Thus, the above equation holds. Therefore, the (PTAT) Proportional to Absolute Temperature current source is self-supporting, forcing the collector current $I_{c2}$ to equal:

$$V_t 1n(A_{Q2}/A_{Q1})/R_1.$$

This is done at the expense of the current of transistor $Q_1$, which must rise or fall to compensate for mismatches. However, when laid out properly on silicon, the collector current $I_C$ variations are minimal as seen in the following figures, FIG. 2 through FIG. 7. Because of this, collector current $I_{c2}$ is a fixed (PTAT) Proportional to Absolute Temperature current, which can be easily mirrored to form an accurate bandgap voltage $V_{ref}$ at output node 12. The advantage of adding transistors $Q_5$, $Q_6$ to the base of transistors $Q_3$ and $Q_4$ forces the circuit to be unconditionally stable, and fairly $V_{cc}$ insensitive without adding a large capacitor. $Q_5$ and $Q_6$ are matched to $Q_4$ and $Q_1$, therefore, if temperature increases, the effects across these transistor pairs cancel out.

In fact, the circuit as shown in FIG. 1 has been tested to be unconditionally stable.

Figure 2:
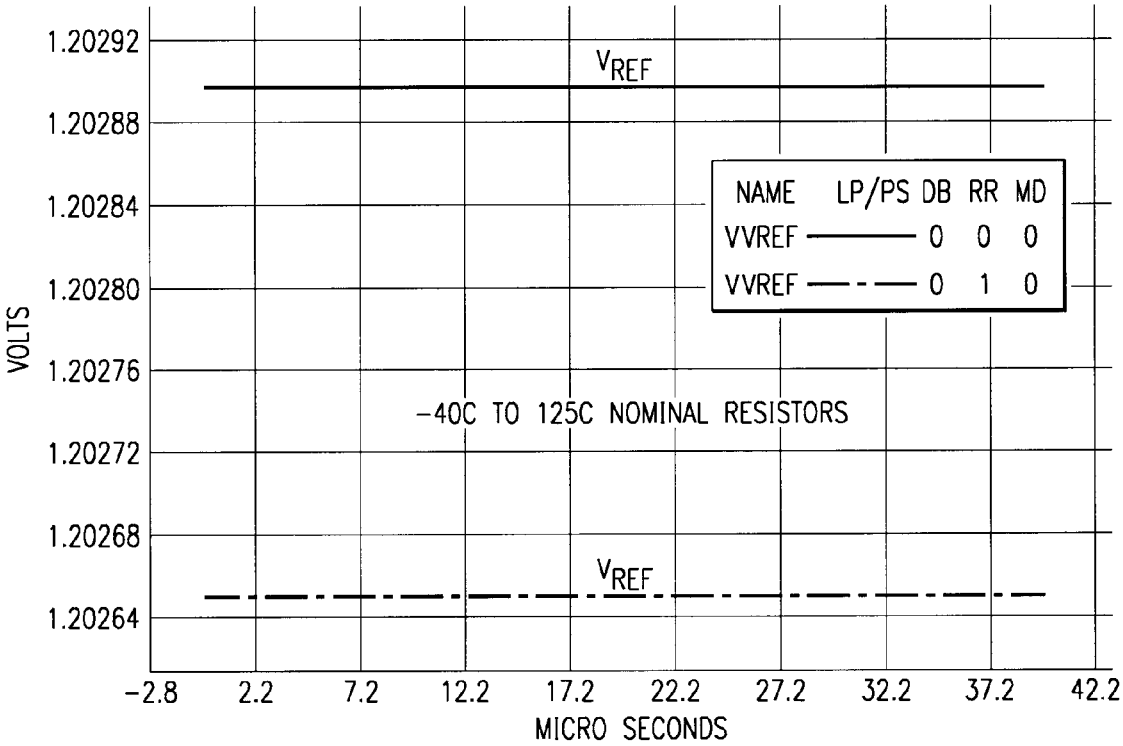
FIG. 2 is a graph of the voltage $V_{ref}$ generated using resistors having nominal values.

Referring to FIG. 2, there is illustrated a graph of the output voltage $V_{ref}$ being approximately 1.2029 using resistors of nominal value.

Figure 3:
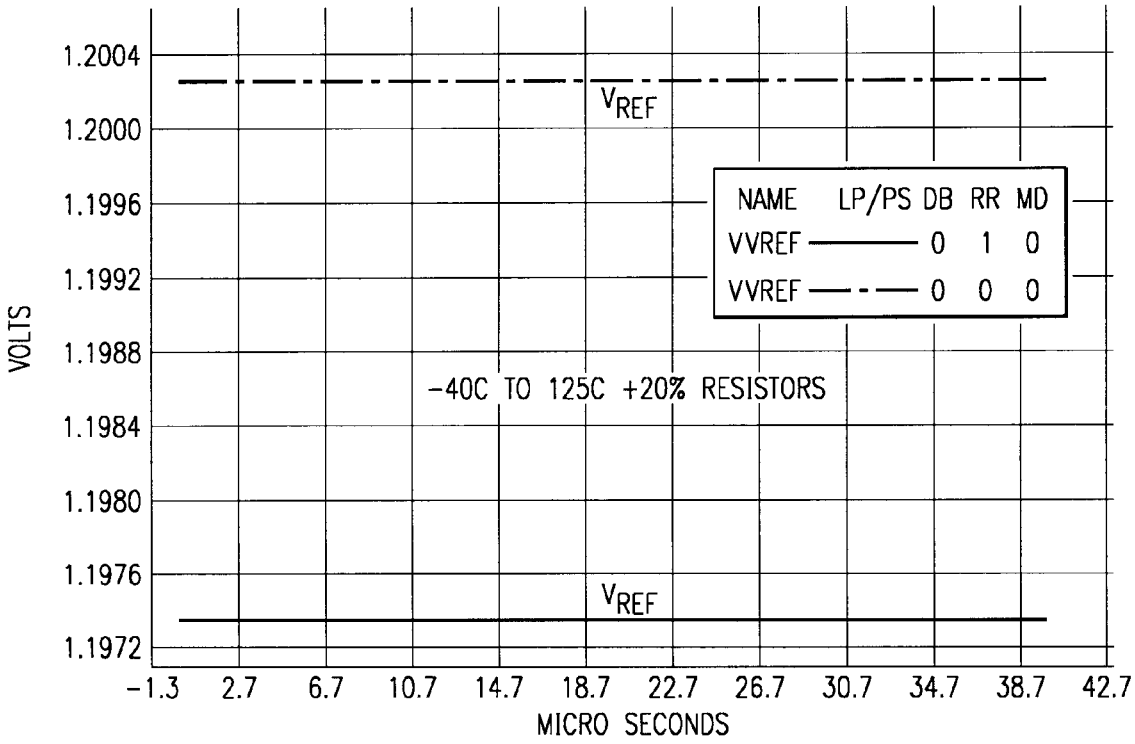
FIG. 3 is a graph of the voltage $V_{ref}$ using resistors having a tolerance of +20% in relation to the nominal resistors values as shown in FIG. 2.

With reference to FIG. 3, there is shown the voltage level of the $V_{ref}$ to be approximately 1.1973 when using resistors having a tolerance of about +20%. This lower reference voltage is referenced with respect to the nominal $V_{ref}$ shown in phantom lines, which, as illustrated, the $V_{ref}$ is seen to vary little even with resistors having values that may be +20% from nominal.

Figure 4:
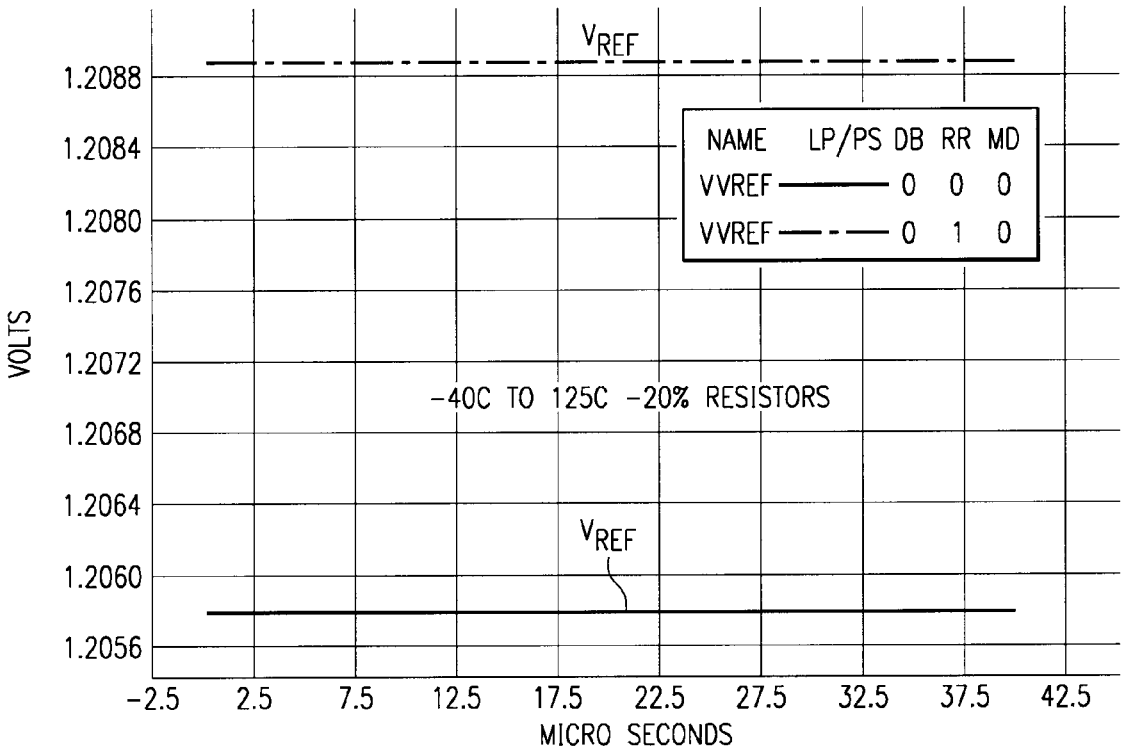
FIG. 4 is a graph of the voltage of $V_{ref}$ using resistors having tolerances of about −20% in relation to the nominal resistor values as shown in FIG. 2.

Similarly, as shown in FIG. 4, using resistors having a tolerance of −20% from nominal as shown in FIG. 2 are seen to generate a reference voltage $V_{ref}$ of about 1.2058, which again, is seen to vary little from the nominal $V_{ref}$ of FIG. 2 having nominal resistor values. However, this circuit does not employ curvature correction so there will be a small $V_{ref}$ change with temperature variation i.e. 3–5 mV across 150° C.

Figure 5:
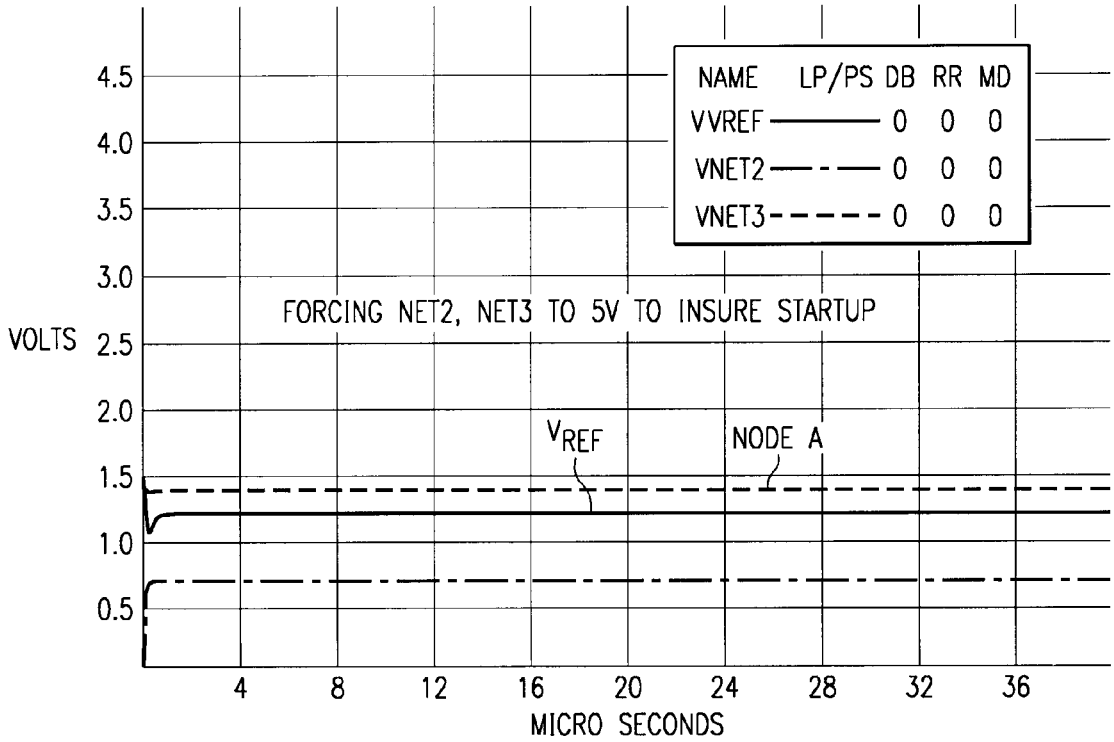
FIG. 5 is a graph of $V_{ref}$ as a function of time during startup with VCC being brought up to 5 volts.

Now with regards to FIG. 5, there is illustrated a graph of the voltage $V_{ref}$ as a function of time whereby the voltage at $V_{cc}$ is brought to +5 volts to ensure startup.

Figure 6:
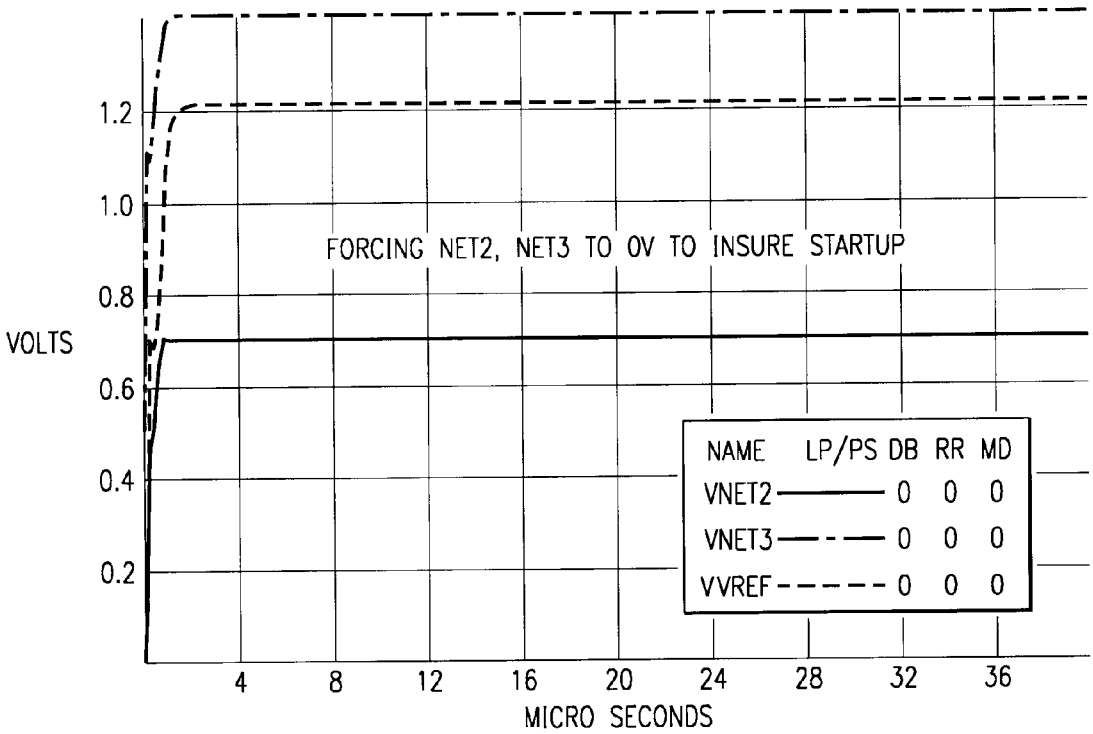
FIG. 6 is a graph of $V_{ref}$ where the voltage at the base of $Q_3$, $Q_4$ is forced to ground and released to ensure startup.

Referring to FIG. 6, there is illustrated a graph of the voltage $V_{ref}$ as a function of time forcing the voltage at node A to 0 volts to ensure startup. The current source is shut off by gounding the bases of $Q_3$ and $Q_4$, and watching the circuit start itself in a stable fashion.

Figure 7:
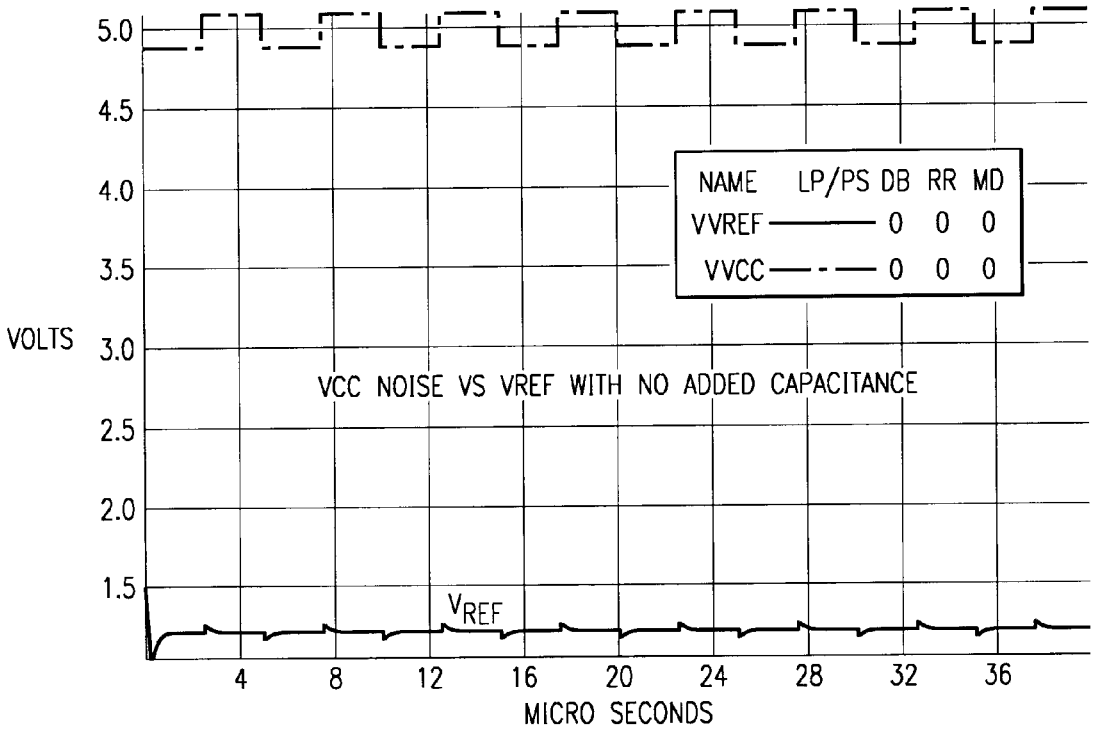
FIG. 7 is a graph of the voltage $V_{ref}$ as a function of time when noise is mixed onto the VCC line, shown as a square wave, and with no capacitance being used in the circuit.

Referring to FIG. 7, there is illustrated the voltage $V_{ref}$ when noise shown as a square wave is mixed and superimposed upon a 5 volt Vcc supply, with no additional capacitance as shown in FIG. 1. It is noted the very small ripple on $V_{ref}$ even with significant noise being injected onto and carried by the voltage $V_{cc}$.

Figure 8:
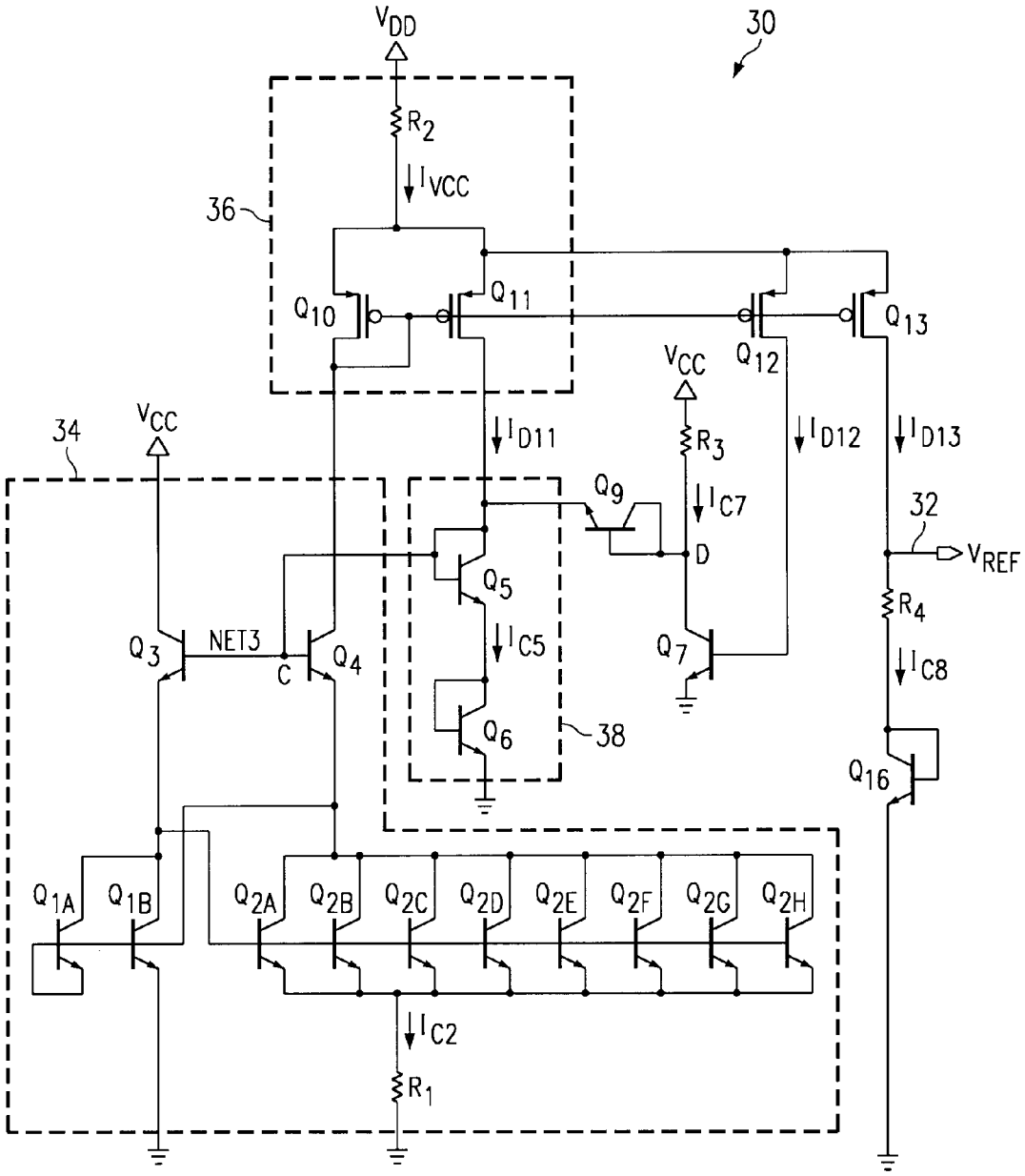
FIG. 8 is a schematic diagram of an alternative preferred embodiment to the present invention shown as a cross-coupled bandgap circuit using bi-CMOS devices.

With reference now to FIG. 8, there is illustrated a second preferred embodiment of the present invention generally shown at 30. In this embodiment, the cross-coupled bandgap circuit is implemented in Bi-CMOS generating an output voltage $V_{ref}$ at output port 32. A cross-coupled current source is shown generally at 34, implemented with bi-polar devices, a standard current mirror being shown at 36 and implemented with CMOS transistors $Q_{10}$, $Q_{11}$, $Q_{12}$ and $Q_{13}$ and the current sink circuit 38 being implemented with bi-polar devices. In this embodiment, the drain current $I_{D11}$ conducted through CMOS transistor $Q_{11}$ is mirrored to current $I_{D13}$ of CMOS transistor $Q_{13}$ and thus conducted through resistor $R_4$ and bi-polar transistor $Q_{16}$ configured as a diode, having its collector tied to its base as shown.

The drive node of the cross-coupled current source 34 is shown at C, whereby the current sink comprising of bi-polar transistors $Q_5$ and $Q_6$ provide a bias voltage/drive voltage at drive node C of approximately 1.2 volts. Bi-polar transistor $Q_2$ is illustrated to have emitters similar to that shown for transistor $Q_2$ in the embodiment of FIG. 1. The cross-coupled current source 34 is identical to that of the cross-coupled current source 14 shown in FIG. 1.

Transistor $Q_9$ is configured as a diode, having its base connected to its collector, and is reversed biased. The drain current $I_{13}$ being the collector current $I_{c8}$ conducting through resistor $R_4$ through transistor $Q_{16}$, is equal to the current $I_{c5}$ and $I_{c2}$ conducting through respective transistors $Q_5$ and $Q_2$ due to current mirror 36.

The cross-coupled bandgap circuit 30 also achieves the same technical advantages of circuit 10 shown in FIG. 1, but has the additional advantages.

Figure 9:
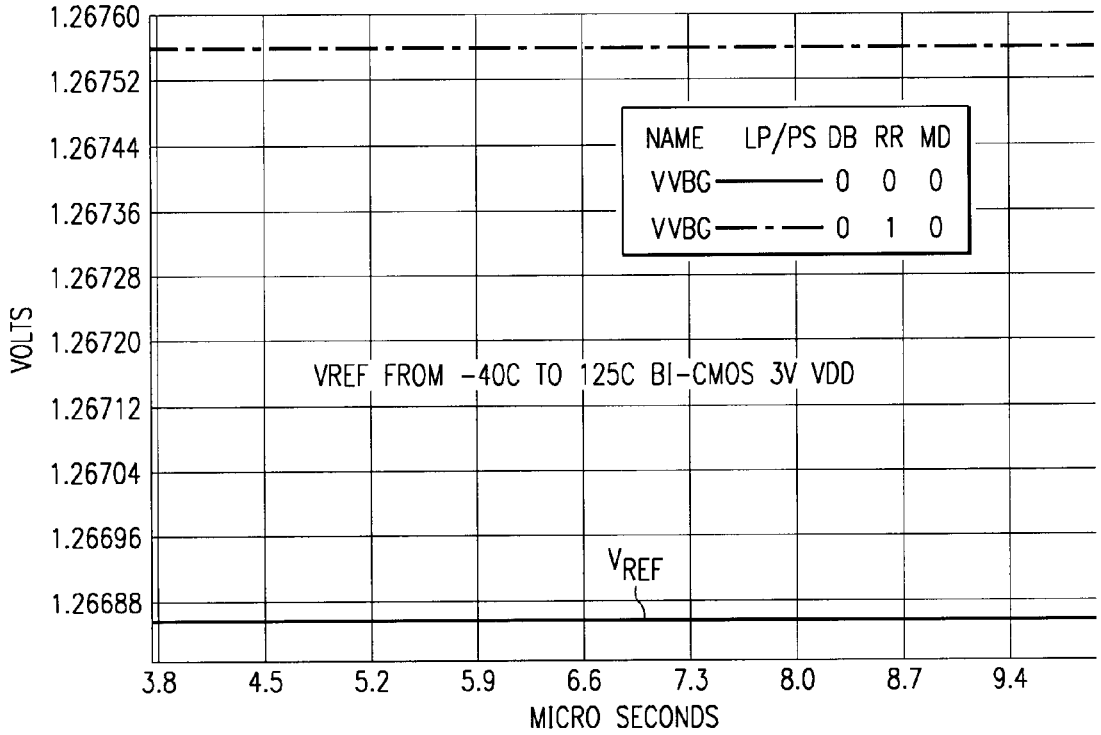
FIG. 9 is a graph of $V_{ref}$ generated by the bi-CMOS circuit of FIG. 8 where the voltage of $V_{dd}$ is set at 3 volts.

Referring now to FIG. 9, there is shown plotted the reference voltage $V_{ref}$ across the temperature ranges of −40° C. to 125° C. with voltage source $V_{DD}$ of 3 volts.

Figure 10:
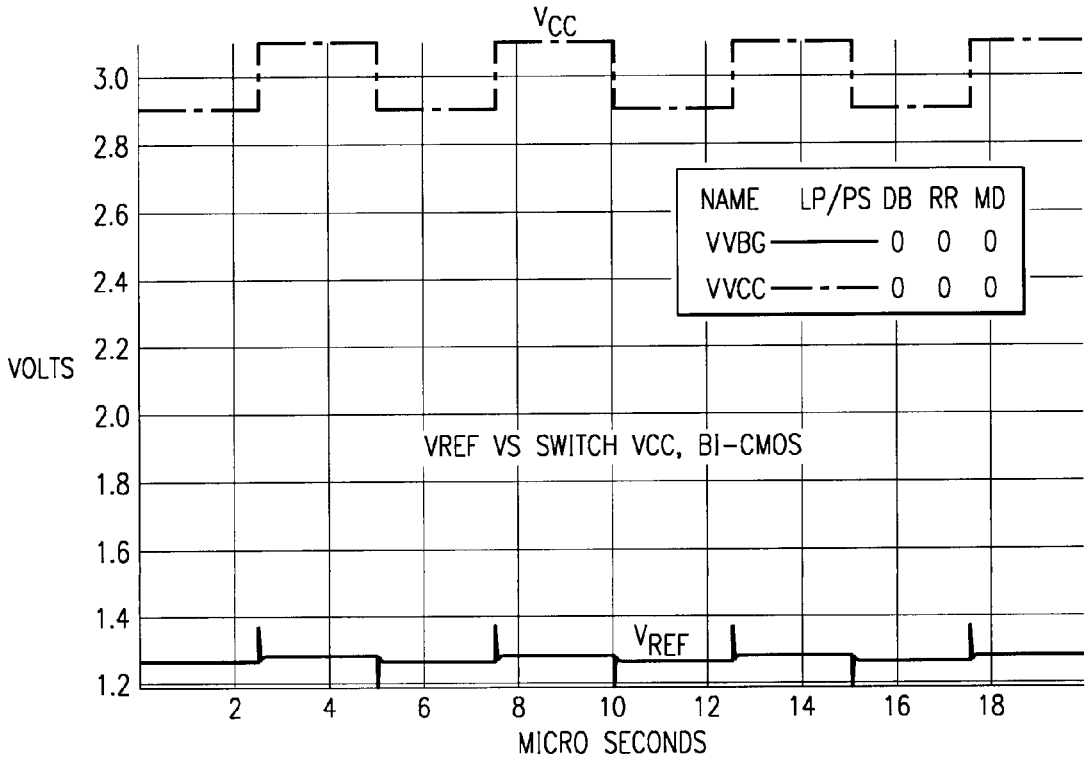
FIG. 10 is a graph of $V_{ref}$ as a function of the voltage $V_{cc}$ for the bi-CMOS circuit of FIG. 8 whereby a square wave of noise is mixed into a 3 volt voltage source VCC.

Referring to FIG. 10, there is illustrated the voltage $V_{ref}$ with noise superimposed on the 3 voltage source $V_{CC}$ illustrated as a square wave. It is noted that the voltage spikes on the voltage output $V_{ref}$ corresponding to the transitions of the square wave carrier superimposed upon the voltage source $V_{CC}$, the deviations (spikes) of the $V_{ref}$ being nominal, and rather insignificant especially without the use of any capacitor.

Figure 11:
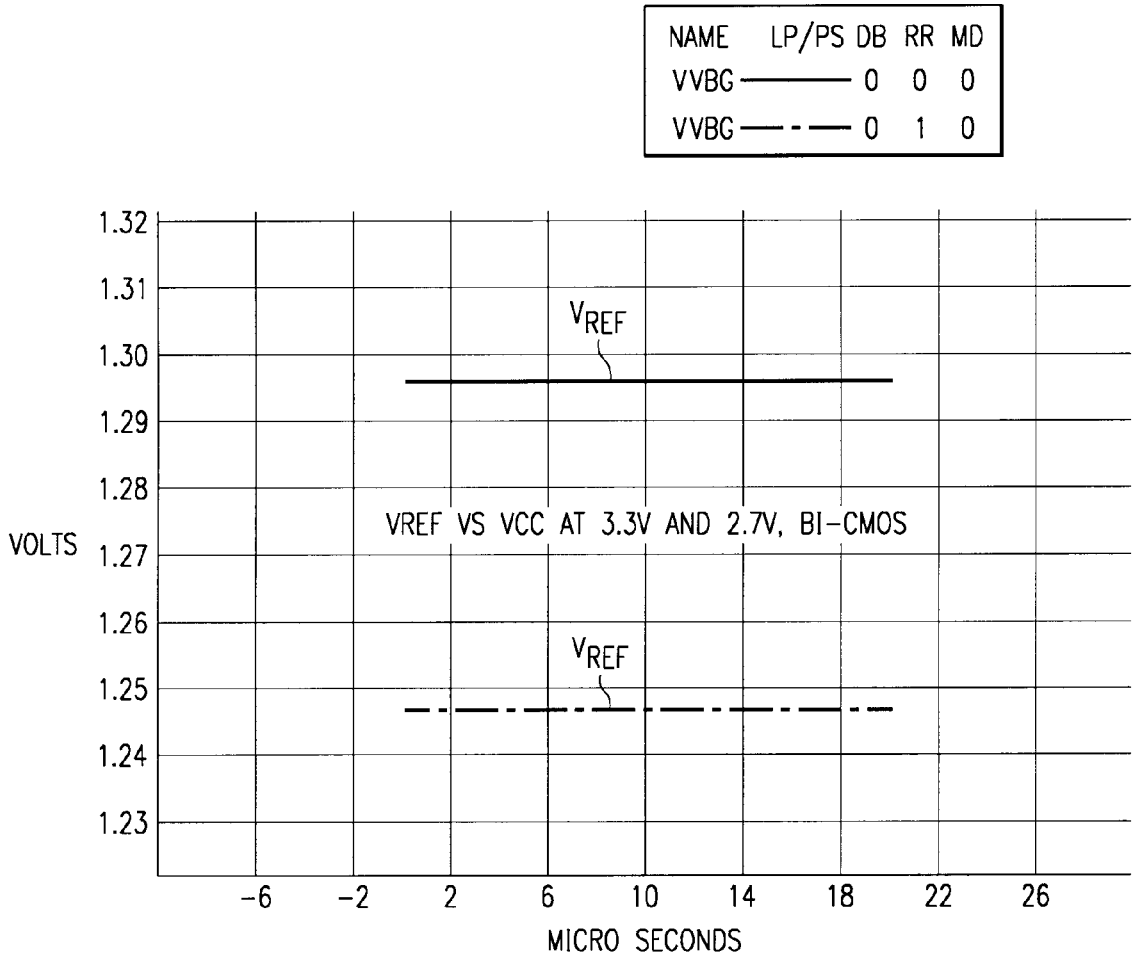
FIG. 11 is a graph of $V_{ref}$ with VCC set at 3.3 volts, and set at 2.7 volts, to illustrate the negligible variance of the $V_{ref}$ generated by the bi-CMOS operating range between 2.7 and 3.3 volts.

Referring now to FIG. 11, there is illustrated the voltage $V_{ref}$ as a function of the voltage source $V_{cc}$ of FIG. 8 at 3.3 volts on the high end, and 2.7 volts on the low end. As shown, the variation of $V_{cc}$ between 2.7 volts and 3.3 volts, a 0.6 volt variation, only causes a variance of $V_{ref}$ of about 0.05 volts, which is excellent voltage reference stability across a wide range of operating voltages for $V_{cc}$.

The cross-coupled bandgap circuit of the present invention derives technical advantages as being suitable for use in operational amplifiers, voltage regulators, phase lock loop (PLL) circuits, or any device requiring a reference that is insensitive, especially to temperature, varying supply voltages, noise, without using a capacitor, and is very compact. The present invention derives technical advantages by implementing a current mirror, preferably a Wilson current mirror, in combination with a current sink to mirror the current of the cross-coupled current source through the current sink to effectively cancel out the effects of base drive temperature variation and voltage supply variations, including any noise thereon. Preferably, the size of the transistors of the current mirror are matched with the size of the transistors of the cross-coupled current source. The size of the transistors (diodes) forming the current sink do not have to be the same size as the other transistors, and may even be half the size of the other transistors without having a noticeable effect on the output $V_{ref}$. The stable voltage reference $V_{ref}$ is achieved by providing a mirror current mirroring the current through the cross-coupled current source through a current sink, which again, is controlled by canceling out the effects of varying temperature and voltage source voltage. The bandgap or ((PTAT) Proportional to AbsoluteTemperature circuit of the present invention is suitable for use between low and high operating voltages, is supply insensitive, and has a relatively low temperature coefficient all in a compact circuit. The present invention works very well up to high operating voltages of 25 volts where other prior devices fail. Where prior art devices require large capacitors for stability and insensitivity, and thus necessitate large die sizes, the generator of the present invention operates without a capacitor down to fairly low operating currents, even down to supply currents of $I_{vcc}$ of between 25 and 100 microamps if care is taken in the startup circuitry. The generator of the present invention can be designed into most IC processes including bi-polar, bi-CMOS and pure CMOS technologies if either diodes or parasitic PNP transistors are available.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

While the invention has been described in conjunction with preferred embodiments, it should be understood that modifications will become apparent to those of ordinary skill in the art and that such modifications are therein to be included within the scope of the invention and the following claims.

What is claimed is:

1. A circuit for providing a reference voltage to an output, comprising:

a current generator having a drive node and comprised of cross-coupled transistors, said current generator having a first current;

a current mirror coupled to said current generator;

a current sink, comprising at least one diode, coupled to said current mirror and coupled to said drive node; and a reference current generator coupled to said current mirror and generating said reference voltage.

2. The circuit as specified in claim 1 wherein said reference current generator comprises a resistor.

3. The circuit as specified in claim 2 wherein said reference current generator further comprises a diode in series with said resistor.

4. The circuit as specified in claim 1 wherein said current mirror comprises a Wilson current mirror.

5. The circuit as specified in claim 1 wherein said current sink comprises a pair of serially connected diodes.

6. The circuit as specified in claim 1 wherein said current generator comprises four transistors cross-coupled to generate said first current.

7. The circuit as specified in claim 6 wherein said current mirror comprises a pair of transistors forming a Wilson current mirror.

8. The circuit as specified in claim 7 wherein said circuit is fabricated on a die, wherein said pair of current mirror transistors have approximately the same die area of at least three of said current generator transistors.

9. The circuit as specified in claim 4 wherein said Wilson current mirror comprises 2 transistors, at least one said transistor having multiple collectors.

10. The circuit as specified in claim 9 wherein a first collector of said multiple collectors is coupled to said drive node, and a second collector of said multiple collectors is coupled to said reference current generator.

11. The circuit as specified in claim 6 wherein at least one of said current generator transistors has multiple emitters each coupled to a resistor R.

* * * * *